United States Patent [19]

Giokas

[11] 4,258,604

[45] Mar. 31, 1981

[54] LIGATURE

[76] Inventor: Dennis G. Giokas, 1824 Ruddel St., Apt. 216, Denton, Tex. 76201

[21] Appl. No.: 21,572

[22] Filed: Mar. 19, 1979

[51] Int. Cl.[3] ..... G10D 9/02

[52] U.S. Cl. ..... 84/383 R

[58] Field of Search ..... 84/383 R, 383 A, 380, 84/382, 385, 453

[56] References Cited

U.S. PATENT DOCUMENTS

| | | | |
|---|---|---|---|
| 555,561 | 3/1896 | Cadwallader | 84/383 R |
| 2,483,327 | 9/1949 | Stalowski | 84/383 R |
| 3,618,440 | 11/1971 | Ratterree | 84/383 R |
| 4,056,997 | 11/1977 | Rovner | 84/383 R |
| 4,185,535 | 1/1980 | Lorenzini | 84/383 R |

FOREIGN PATENT DOCUMENTS

| | | | |
|---|---|---|---|
| 384940 | 3/1923 | Fed. Rep. of Germany | 84/383 R |

*Primary Examiner*—Lawrence R. Franklin
*Attorney, Agent, or Firm*—Arthur F. Zobal

[57] ABSTRACT

A ligature for holding a reed onto the mouthpiece of a musical instrument, comprising two arcuate shaped solid members adapted to be located partially around the mouthpiece and strings connected to the arcuate members to be located around the remaining portion of the mouthpiece for holding the reed onto the mouthpiece. Locking means is provided for connecting together the other ends of the arcuate shaped members.

4 Claims, 3 Drawing Figures

LIGATURE

BACKGROUND OF THE INVENTION

1. Field of the Invention

This invention relates to a ligature for holdng a reed onto the mouthpiece of a musical instrument.

2. Decsription of the Prior Art

Ring shaped solid ligatures and string ligatures are known. A string ligature has advantages due to its damping potential which affects the tane and response of the instrument, and ability to follow the contour of the reed. A ring shaped solid ligature has advantages due to its ease of attachment although it has disadvantages since it cannot conform to the curvature of the reed in all cases, and has some disadvantages in tane and response.

SUMMARY OF THE INVENTION

It is an object of the present invention to provide a ligature having the advantages of both the string and solid ring shaped ligature and which also results in a different tone quality, and different response.

The ligature of the present invention comprises two arcuate shaped solid members adapted to be located partially around the mouthpiece of a musical instrument and strings connected to the arcuate shaped members to be located around the remaining portion of the mouthpiece for holding a reed onto the mouthpiece. Locking means is provided for connecting together the other ends of the arcuate shaped members.

DESCRIPTION OF THE PREFERRED EMBODIMENTS

Figure 3:
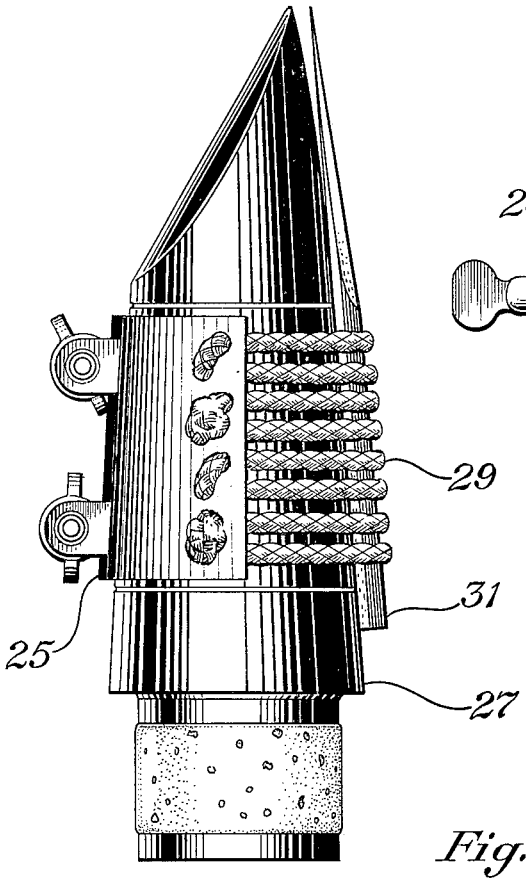
FIG. 3 illustrates the ligature of FIGS. 1 and 2 fitted around the mouthpiece of a musical instrument and holding a reed onto the mouthpiece.
Figure 2:
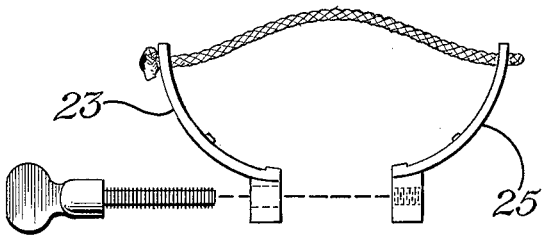
FIG. 2 is an end view of the ligature of FIG. 1.

Referring now to the drawings, the ligature of the present invention is identified at 21. It comprises two arcuate shaped members 23 and 25 adapted to be located partially around a mouthpiece 27 of a musical instrument as shown in FIG. 3. The mouthpiece may be that of a clarinet, saxophone or other type of similar instrument with which a reed may be employed. A plurality of flexible strings 29 are connected to ends 23A and 25A of members 23 and 25 along their length. The strings 29 are adapted to be located around the remaining portion of the mouthpiece for holding a reed 31 onto the mouthpiece as seen in FIG. 3. Extending from ends 23B and 25B of members 23 and 25 are two pairs of lugs 33 and 35 respectively. Lugs 33 have apertures 37 formed therethrough for freely receiving threaded members 39. Lugs 35 have threaded apertures 41 formed therethrough into which the members 39 may be threaded.

After the ligature 21 has been located around the mouthpiece with the reed between the mouthpiece and the strings 29, it is tightly locked in place by inserting members 39 through apertures 37 and then threading them into apertures 41.

As can be understood, the ligature of the present invention can be readily assembled in place to hold a reed onto a mouthpiece with the strings 29 conforming to the contour of the reed. In addition, as indicated above, a different tone quality may be achieved, and different response quality.

Figure 1:
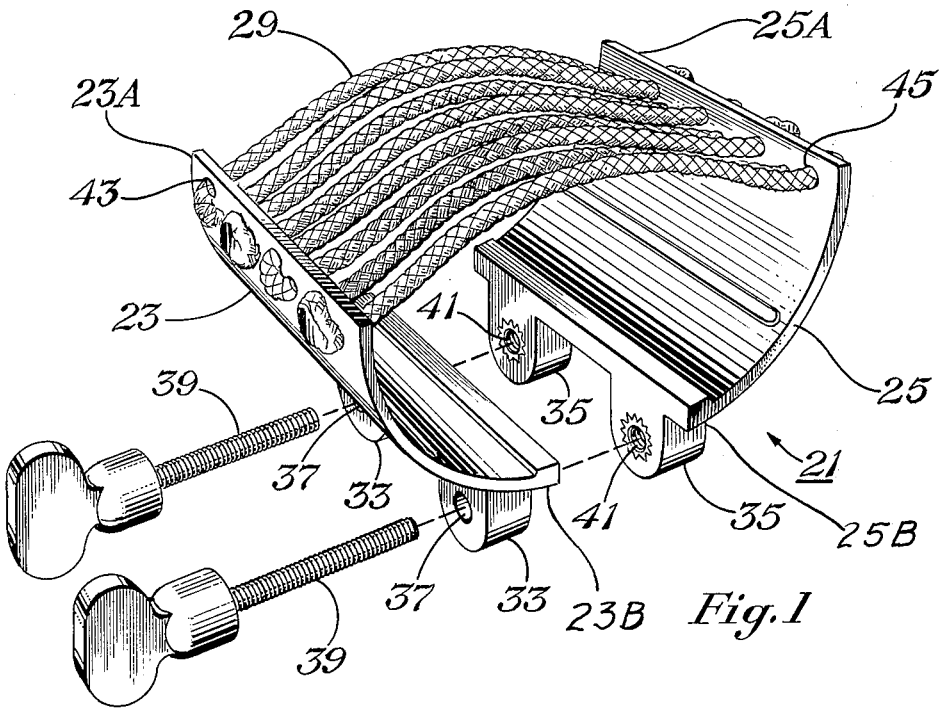
FIG. 1 illustrates the ligature of the present invention.

As shown in FIG. 1, members 23 and 25 have a plurality of apertures 43 and 45 formed through ends 23A and 25A respectively for receiving the strings 29. The strings 29 may comprise one or more string members strung through the apertures with their ends knotted or enlarged for holding the strings in place.

In one embodiment, the members 23 and 25 may be formed of plastic or metal and the strings 29 formed of nylon, or any other flexible material or flexible strips.

What is claimed is:

1. A ligature for holding a reed onto the mouthpiece of a musical instrument, comprising:

a. two arcuate shaped members adapted to be located partially around the mouthpiece, each arcuate shaped member comprising a solid arcuate member having a plurality of spaced apart apertures formed therethrough at a first end thereof, b. flexible string means extending through said apertures at said first ends of said two arcuate shaped members to be located around the remaining portion of the mouthpiece for holding the reed onto the mouthpiece, and c. locking means for connecting together the other ends of said two arcuate shaped members for locking the ligature in place around the mouthpiece with the reed held between the mouthpiece and said flexible string means.

2. The ligature of claim 1 wherein said locking means comprises two threaded means for connecting together the other ends of said two arcuate shaped members.

3. The ligature of claim 1 or 2 wherein said string means is formed of nylon.

4. The ligature of claims 1 or 2 wherein:

said first end and said other end of each arcuate shaped member are spaced apart and define opposite ends of each said arcuate shaped members, said locking means comprises:

threaded aperture means formed through said other end of one of said arcuate shaped members, aperture means formed through said other end of the other of said arcuate shaped members, and threaded means adapted to be inserted through said aperture means formed through said other end of the other of said arcuate shaped members and to be threaded into said threaded aperture means formed through said other end of said one arcuate shaped member for connecting together said other ends of said two arcuate shaped members.

* * * * *